US007614784B2

(12) United States Patent
Watanabe

(10) Patent No.: US 7,614,784 B2
(45) Date of Patent: Nov. 10, 2009

(54) RESIDUAL WOUND QUANTITY DISPLAY MECHANISM OF TIMEPIECE AND TIMEPIECE WITH RESIDUAL WOUND QUANTITY DISPLAY MECHANISM

(75) Inventor: Mamoru Watanabe, Chiba (JP)

(73) Assignee: Seiko Instruments Inc. (JP)

( * ) Notice: Subject to any disclaimer, the term of this patent is extended or adjusted under 35 U.S.C. 154(b) by 77 days.

(21) Appl. No.: 12/012,832

(22) Filed: Feb. 6, 2008

(65) Prior Publication Data

US 2008/0205199 A1 Aug. 28, 2008

(30) Foreign Application Priority Data

Feb. 9, 2007 (JP) ..... 2007-030283

(51) Int. Cl.
*G04B 9/00* (2006.01)

(52) U.S. Cl. ..... 368/210; 368/212

(58) Field of Classification Search ..... 368/145–154, 368/206, 210, 212
See application file for complete search history.

(56) References Cited

U.S. PATENT DOCUMENTS 738,971 A * 9/1903 Anderson ..... 368/210
904,332 A * 11/1908 Kahan ..... 368/212
5,828,628 A * 10/1998 Born et al. ..... 368/66
6,166,999 A * 12/2000 Jujo et al. ..... 368/66
7,357,568 B2 * 4/2008 Gerber et al. ..... 368/212
2005/0162982 A1 7/2005 Suzuki
2006/0187758 A1 8/2006 Takahashi

* cited by examiner

*Primary Examiner*—Vit W Miska
(74) *Attorney, Agent, or Firm*—Adams & Wilks

(57) ABSTRACT

To provide a residual wound quantity display mechanism of a timepiece, in which it is possible to change a way of a display without changing a basic structure, and a timepiece with the mechanism concerned. A residual wound quantity display mechanism of a mechanical timepiece has an output gearwheel rotating in compliance with a change in a residual wound quantity of a mainspring; a drive lever possessing monolithically a fan-shaped gearwheel part meshing with the output gearwheel, and an arm part extending from a rotation center of the fan-shaped gearwheel part in a direction different from a fan-shaped portion of the fan-shaped gearwheel part; a display member possessing a drive gearwheel part rotatably supported to a tip part of the arm part of the drive lever, and a display arbor formed monolithically in the drive gearwheel part in a site separated from a rotation center of the drive gearwheel part; and a fixation gearwheel possessing a fixation tooth part with which a tooth part of the drive gearwheel part of the display member meshes. Typically the fixation gearwheel adopts a form of the internally-toothed gearwheel.

20 Claims, 20 Drawing Sheets

RESIDUAL WOUND QUANTITY DISPLAY MECHANISM OF TIMEPIECE AND TIMEPIECE WITH RESIDUAL WOUND QUANTITY DISPLAY MECHANISM

BACKGROUND OF THE INVENTION

1. Field of the Invention

The present invention relates to a residual wound quantity display mechanism of a timepiece, and a timepiece with the residual wound quantity display mechanism.

2. Description of the Related Art

In a timepiece in which at least one part of a drive source is a mainspring, there is proposed an attempt conceiving an idea in a display of a residual wound quantity or a power reserve quantity (residual mainspring-wound quantity or residual mainspring quantity) (e.g., Patent Documents JP-A-2005-214655 Gazette, JP-A-2006-234432 Gazette and JP-A-2006-234433 Gazette).

JP-A-2005-214655 discloses about a residual wound quantity display mechanism made so as to display the residual mainspring quantity by driving a winding display wheel in a place separated from an output gearwheel rotating in compliance with a change in the residual wound quantity of the mainspring by using a gearwheel (here, called a segment gearwheel) possessing monolithically plural segments or sector gearwheel parts (fan-shaped gearwheel parts).

By this, although a display region can be selected, a display itself is not different from a conventional arc-like or fan-shaped display and, from the fact that a center of the arc or fan in the display concerned exists in a range of a spread of the timepiece, it is difficult to cause a user who can see only an external appearance to feel a change (idea).

Although JP-A-2006-234432 is one having a novelty in the display in a point that there is performed a display like a straight line, it is one in which a male thread and a female thread are combined for the display like the straight line, so that a display in a form other than the straight line is actually impossible.

Although JP-A-2006-234433 differs from a conventional, general display in a point that there are performed both of a display of a 10-hour unit and a display of a time interval smaller than the former, there is no difference from the conventional, general display in a point that display hands are rotated about each center.

SUMMARY OF THE INVENTION

It is an aspect of the present invention to provide a residual wound quantity display mechanism of a timepiece, in which it is possible to change a way of the display without changing a basic structure, and a timepiece with the mechanism concerned.

In order to achieve the above aspect, a residual wound quantity display mechanism of a timepiece of the present invention has an output gearwheel rotating in compliance with a change in a residual wound quantity of a mainspring; a drive lever possessing monolithically a fan-shaped gearwheel part meshing with the output gearwheel, and an arm part extending from a rotation center of the fan-shaped gearwheel part in a direction different from a fan-shaped portion of the fan-shaped gearwheel part; a display member possessing a drive gearwheel part rotatably supported to the arm part of the drive lever, and a display arbor formed monolithically in the drive gearwheel part in a site separated from a rotation center of the drive gearwheel part; and a fixation gearwheel possessing a fixation tooth part with which a tooth part of the drive gearwheel part of the display member meshes.

In the residual wound quantity display mechanism of the timepiece of the present invention, by having the above structure or constitution, a rotation of the output gearwheel, which complies with a change in the residual wound quantity of the mainspring, is converted into a rotation of the drive lever, which complies with the former rotation, further the rotation of the drive lever is converted into a rotation of the drive gearwheel part, and additionally the rotation of the drive gearwheel part is displayed finally as a locus of a display arbor.

Incidentally, typically, the display arbor protrudes to a front face side of a dial while penetrating through a slit (shape of the locus) formed in the dial, and displays the residual wound quantity (mainspring residual quantity or power reserve quantity) in regard to a residual quantity display graduation formed along the slit concerned in the dial. Typically, a residual wound quantity display plate is attached to a protruded end of the display arbor.

In such a residual wound quantity display mechanism of the timepiece of the present invention as mentioned above, the locus of the display arbor is a cycloid or trochoid in abroad sense. In a case where the fixation gearwheel is like a convex, i.e., an externally-toothed gearwheel, the locus of the display arbor becomes an external trochoid (epitrochoid) and, in a case where the fixation gearwheel is like a concave, i.e., an internally-toothed gearwheel (internal gearwheel), the locus of the display arbor becomes an internal trochoid (hypotrochoid) In a case where a distance from the display arbor till the rotation center of the drive gearwheel part coincides with a radius of a pitch circle of the drive gearwheel part, the external trochoid and the internal trochoid become respectively an external cycloid (epicycloid) and an internal cycloid (hypocycloid). In a case where the fixation gearwheel is a rack tooth like a straight line, the locus of the display arbor becomes a cycloid in a narrow sense.

Accordingly, by setting the distance from the display arbor till the rotation center of the drive gearwheel part to a desired dimension different from the radius of the pitch circle of the drive gearwheel part, it becomes possible that the locus of the display arbor can be made not only like a curve which is convex outward in regard to the timepiece as the prior art for instance, but also like the straight line or also like a curve which is convex inward in regard to the timepiece, and further it becomes also possible to change a radius of curvature of the arc-like curve. Here, "arc-like" may be curve-like (pseudo-arc-like) approximating to an arc when seen roughly, instead of a strict arc whose radius of curvature is constant. Incidentally, from the fact that the display arbor suffices if it expresses a locus of one portion among the above-mentioned loci, in a case where, e.g., the hypotrochoid has a portion capable of being approximated to the straight line not under a condition becoming strictly the straight line, it is also possible to perform a straight-line-like display by utilizing that portion.

Incidentally, in the above, as to the above arm part of the drive lever, the fact that a direction is "different from a fan-shaped portion of the fan-shaped gearwheel part" means the fact that the above arm part of the drive lever is formed separately from an arm part comprising the fan-shaped portion of the fan-shaped gearwheel. Further, in the drive gearwheel part, although one part of the arc becomes typically an arm part for attaching the display arbor not a complete circle, if desired, it may be the complete circle. In that case, the arm part for attaching the display arbor is provided protrusively from the drive gear part like an S-shape for instance, and formed in a position deviated in a thickness direction of the drive gearwheel part.

In a residual wound quantity display mechanism of a timepiece of the present invention, the fixation gearwheel typically comprises an internally-toothed gearwheel (internal gearwheel). By this, a novel display, such as the straight-line display (there may a pseudo-straight-line-like display) or a display like a curve internally convex when seen from a dial side of the timepiece, becomes possible. However, in the residual wound quantity display mechanism of the timepiece of the present invention, if desired, the fixation gearwheel may be an externally-toothed gearwheel (external gearwheel).

Further, in a residual wound quantity display mechanism of a timepiece of the present invention, a distance from the display arbor till the rotation center of the drive gearwheel part is, e.g., smaller than a radius of a pitch circle of the drive gearwheel part.

In that case, it is possible to give the novel display in comparison with the prior art. That is, e.g., such a display is possible that the locus (display by the display arbor) of the display arbor is like a pseudo-straight line, or that a center of the arc (pseudo-arc), which is internally convex and whose radius of curvature is comparatively large, is placed in an outside than the timepiece or a movement.

Further, in a residual wound quantity display mechanism of a timepiece of the present invention, a distance from the display arbor till the rotation center of the drive gearwheel part may be, e.g., larger than a radius of a pitch circle of the drive gearwheel part.

In that case, it is liable to become the novel display in comparison with the prior art and, for example, the locus formed by the display arbor is like the arc, and such a display is possible that the center of the arc is placed in the outside than the timepiece or the movement.

If prescribed in another viewpoint, in the residual-wound quantity display mechanism of the timepiece of the present invention, by changing a ratio between the radius of the pitch circle of the drive gearwheel part and a radius of a pitch circle of the fixation gearwheel part, the locus can be altered to a desired form.

For example, in the residual wound quantity display mechanism of the timepiece of the present invention, the radius of the pitch circle of the drive gearwheel part is ½ of the radius of the pitch circle of the fixation gearwheel part, and the distance from the display arbor till the rotation center of the drive gearwheel part is equal to the radius of the pitch circle of the drive gearwheel part. In that case, the locus of the display arbor becomes literally the straight line.

Further, in a residual wound quantity display mechanism of a timepiece of the present invention, typically, a rotation center of the drive lever exists inside a region prescribed by a line connecting the fixation gearwheel and the output gearwheel. In that case, the locus of the display arbor is displayed in a side in a diameter direction, which is approximately reverse to a position of the output gearwheel.

However, instead of it, in a residual wound quantity display mechanism of a timepiece of the present invention, a rotation center of the drive lever may exist outside a region prescribed by a line connecting the fixation gearwheel and the output gearwheel. In that case, the locus of the display arbor is displayed laterally (e.g., such a position as being different by about 90 degrees) in regard to the position of the output gearwheel.

In the above, in order to lengthen a length of the arm part of the drive lever etc., at its maximum, the drive lever is disposed such that its rotation center is placed typically in a center of the timepiece or the movement, or its vicinity. However, in order to cause a component concerning the residual wound quantity display mechanism to locally exist in a region of one part of the timepiece or the movement or give a change in a direction of the display, the rotation center of the drive lever may be provided in a place separated from the center of the timepiece or the movement. Similarly, in a case where the fixation gearwheel comprises the internally-toothed gearwheel (internal gearwheel), typically, although the fixation gearwheel is disposed near an outer periphery of the timepiece or the movement, if desired, it may be disposed in a center part of the timepiece or the movement.

Further, in the above, typically, the drive lever and the fixation gearwheel are supported by a stationary support body of a main plate or other. However, if desired, in order to indicate at least one between the drive lever and the fixation gearwheel, an exclusive stationary support body may be provided. Here, the stationary support body means one supporting a timepiece component while being disposed stationary in regard to a case of the timepiece, like the main plate.

In order to achieve the above aspect, a timepiece with a residual wound quantity display mechanism of the present invention possesses the residual wound quantity display mechanism like the above.

BRIEF DESCRIPTION OF THE DRAWINGS

-FIG. 8, about an operation state of the residual wound quantity display mechanism of FIG. 17.

DESCRIPTION OF THE PREFERRED EMBODIMENTS

Some of desirable implementation modes of the present invention are explained on the basis of desirable embodiments shown in the appended drawings.

Embodiment 1

Figure 1:
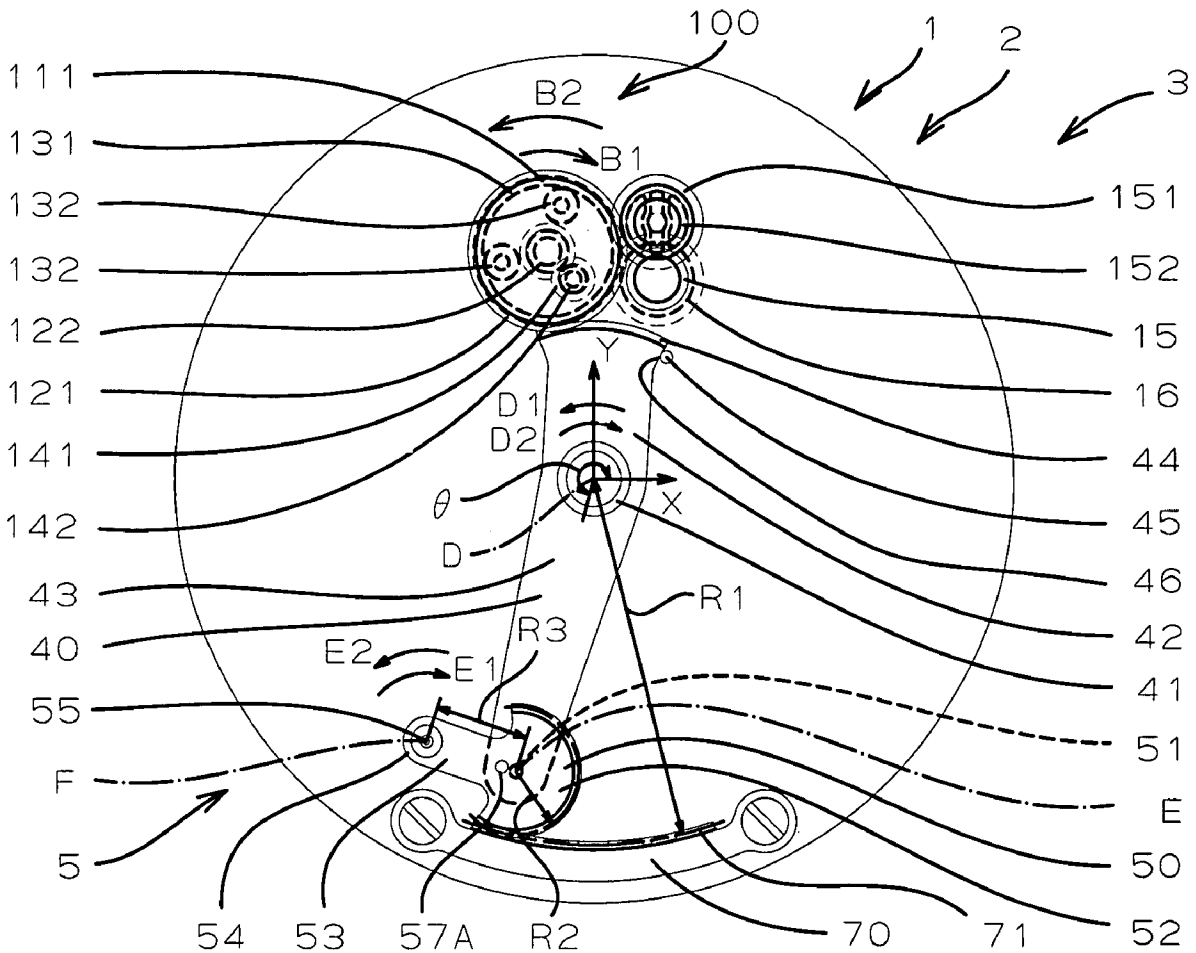
FIG. 1 is an explanatory plan view of a mechanical timepiece possessing a residual wound quantity display mechanism of one desirable embodiment of the present invention.
Figure 2:
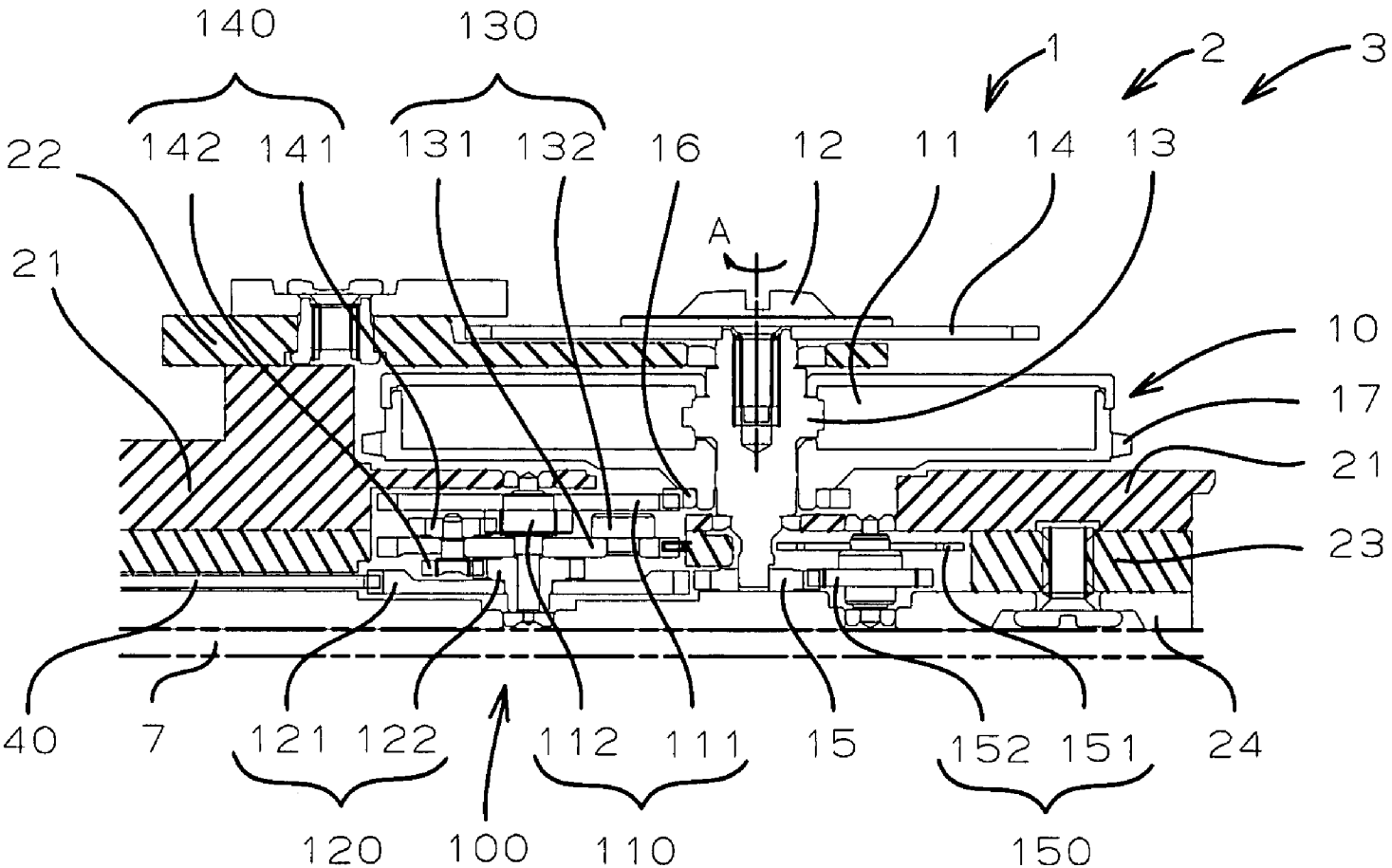
FIG. 2 is an explanatory sectional view showing linkages among a barrel drum and a planetary unit as well as a drive lever of the residual wound quantity display mechanism within the mechanical timepiece of FIG. 1.
Figure 3:
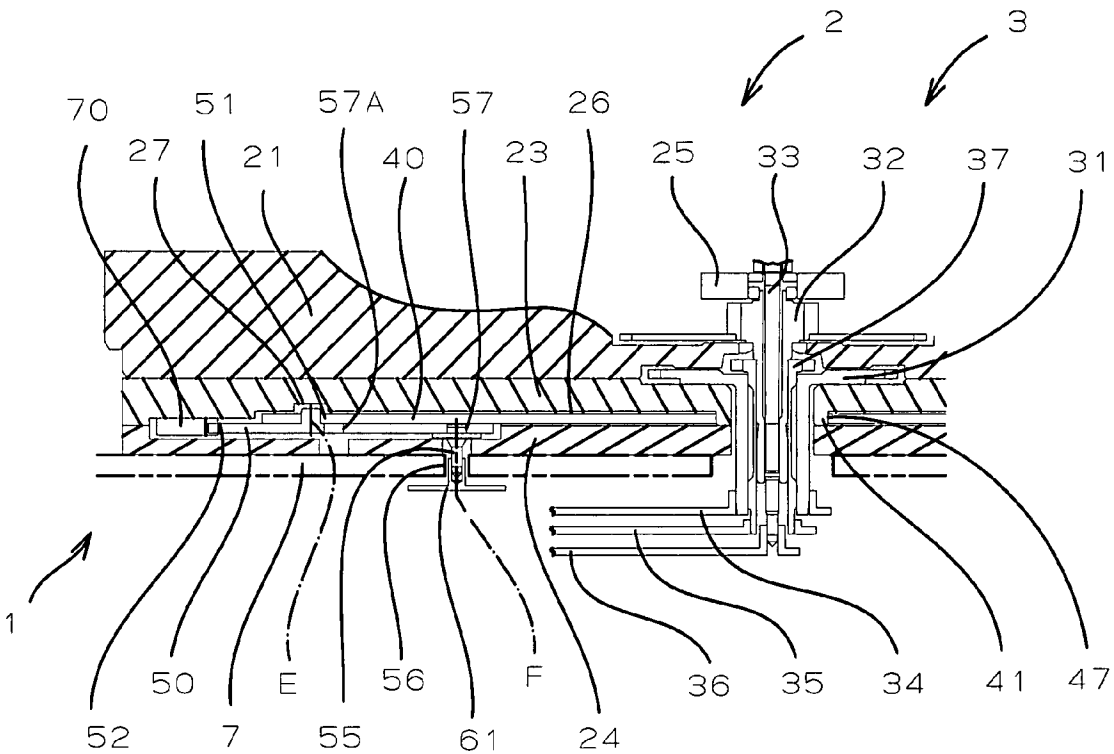
FIG. 3 is an explanatory sectional view showing mainly a portion of the residual wound quantity display mechanism of the mechanical timepiece of FIG. 1.

In FIG. 1-FIG. 3, there is shown a main body part or a movement 3 of a mechanical timepiece 2 possessing a residual wound quantity display mechanism 1 of one desirable embodiment of the present invention.

As shown in FIG. 2, the movement 3 of the timepiece 2 possesses a barrel drum 10 and, as understood from FIG. 1, the residual wound quantity display mechanism 1 has a planetary wheel mechanism or a planetary unit 100 and a residual wound quantity display mechanism main body part 5. In this example, the movement 3 includes, as stationary support bodies, a main plate 21, a barrel bridge 22, and main plate 23, a 2nd train wheel bridge 24, a center wheel bridge 25 (FIG. 3), and the like.

The barrel drum 10 possesses in its inside a mainspring 11, and the mainspring 11 is wound in compliance with a rotation of a ratchet wheel 14 fixed to a barrel arbor 13 by a ratchet wheel screw 12. When winding the mainspring 11, a barrel arbor pinion 15 attached to the barrel arbor 13 is rotated and, when unwinding the mainspring 11, a barrel pinion 16 is rotated together with a barrel gearwheel 17.

The planetary unit 100 has a 1st sun wheel 110 possessing a 1st sun gearwheel 111 meshing with the barrel pinion 16 and a 1st sun pinion 112; a 2nd sun wheel 120 which possesses a 2nd sun gearwheel 121 and a 2nd sun pinion 122 and is coaxial with the 1st sun wheel 110; a planetary intermediate wheel 130 which possesses a planetary intermediate gearwheel 131 and spacers 132, 132 (FIG. 1) and is coaxial with the 1st and 2nd sun wheels 110, 120; and a planetary wheel 140 comprising a 1st planetary gearwheel 141 meshed with the 1st sun pinion 112 and rotatably supported to the planetary intermediate wheel 130, and a 2nd planetary gearwheel 142 which is meshed with the 2nd sun pinion 122, coaxial with the 1st planetary gearwheel 141, and whose diameter is smaller than the 1st planetary gearwheel. The planetary intermediate gearwheel 131 is meshed with the barrel arbor pinion 15 through a planetary transmission wheel 150. The planetary transmission wheel 150 comprises a planetary transmission gearwheel 151 meshed with the planetary intermediate gearwheel 131, and a planetary transmission pinion 152 monolithic with the planetary intermediate gearwheel.

Accordingly, in compliance with an A-direction rotation of the barrel arbor pinion 15, which follows upon the winding of the mainspring 11, the 2nd sun gearwheel 121 of the planetary unit 100 is rotated in a B2-direction and, in compliance with the A-direction rotation of the barrel pinion 16, which follows upon the unwinding of the mainspring 11, the 2nd sun gearwheel 121 of the planetary unit 100 is rotated in a B1-direction. Here, the 2nd sun gearwheel 121 of the planetary unit 100 acts as an output gearwheel of the residual wound quantity display mechanism 1. So long as the output gearwheel of the residual wound quantity display mechanism 1 is rotated in reverse directions in compliance with the winding and the unwinding of the mainspring 11, there may be any other one instead of the 2nd sum wheel 121 of the planetary unit 100.

Incidentally, as shown in FIG. 3, the movement 3 of the mechanical timepiece 2 possesses coaxially an hour wheel 31, a cannon pinion 37, a center wheel & pinion 32 and a second wheel & pinion 33, and an hour hand 34, a minute hand 35 and a second hand 36 are attached respectively to the wheels 31, 32 and 37. Accordingly, in compliance with the unwinding of the mainspring.11, the hour wheel 31, the center wheel & pinion 32 and the second wheel & pinion 33 are rotated through a train wheel (not shown in the drawing) including the cannon pinion 37, and a time instant is displayed by the hour hand 34, the minute hand 35 and the second hand 36, which rotate in a front face of a dial 7.

As understood mainly from FIG. 1, the main body part 5 of the residual wound quantity display mechanism 1 possesses a drive lever 40 supported to the 2nd main plate 23 (FIG. 3) so as to be rotatable in D1- and D2-directions about a rotation axle 41, a display member 50 supported to the drive lever 40 so as to be rotatable in E1- and E2-directions about a rotation axle 51, and a fixation gearwheel 70 fixed to the 2nd main plate. 23 (FIG. 3). Hereunder, a rotation center axis of the rotation axle 41 is denoted by D, and a rotation center axis of the rotation axle 51 is denoted by E.

The drive lever 40 possesses a short arm part 42 in one side of the rotation axle 41, and possesses a long arm part 43 in an approximately diameter direction reverse side (in more detail, a direction slanting by about 150 degrees-170 degrees in regard to the arm part 42) in regard to the arm part 42. In this example, the drive lever 40 is made rotatable about the center axis D in regard to the 2nd main plate 23 by being fitted in a rotation axle reception hole 47 to the rotation axle 41 formed by an annular convex part of the 2nd main plate 23. By this, a center of the mechanical timepiece 2 can be made the rotation center axis D of the drive lever 40. However, in a case where the drive lever 40 is disposed in a place deviated from the center of the timepiece 2, if desired, the rotation axle 41 of the drive lever 40 may be made an axle part monolithic with the arms 42, 43 and the like, and a hole part rotatably supporting the axle part may be previously formed in the stationary support body. Further, in this example, the 2nd main plate 23 has a concave part 26 rotatably receiving the drive lever 40. In an end edge of the short arm part 42, there is formed a fan-shaped gearwheel part (i.e., a sector gearwheel part or a segment gearwheel part) 44 meshing with the 2nd sun gearwheel 121 as an output gearwheel. In a vicinity of a tip part of the long arm part 43, the display member 50 is rotatably supported through the rotation axle 51. Incidentally, an angle determination pin 45 implanted to the 2nd main plate 23 regulates a rotation range of the drive lever 40 in the D2-direction, thereby prescribing an initial position of the drive lever 40.

In this example, the fixation gearwheel 70 comprises an arc-like internally-toothed gearwheel (internal gearwheel) 71 in which a radius of a pitch circle is R1. A center of the pitch circle of the fixation gearwheel 71 coincides with the rotation center axis D.

The display member 50 has a drive gearwheel part 52 possessing an arc-like pitch circle of a radius R2 with the rotation center axis E being made a center, and a display arbor 55 attached to a tip part 54 of a display arm part 53 extending in a diameter direction reverse direction in regard to the drive gearwheel part 52 from a place of the rotation axle 51 of the drive gearwheel part 52. In this example, the 2nd main plate 23 possesses an arc-like groove part 27 receiving a protruded end part of the rotation axle 51 of the drive gearwheel part 52 and allowing an arc-like movement of the protruded end part.

A distance between a center F of the display arbor 55 and the rotation center axis E is R3. In more detail, as understood from FIG. 3, in this example, the display member 50 has display arbor attachment holes 57, 57A in the arm part 53. The display arbor attachment hole 57A is placed near the rotation center axis E, and the display arbor attachment hole 57 exists in a place separated from the rotation center axis E than the hole 57A. In the example of FIG. 1-FIG. 3, the display arbor 55 is fitted to the display arbor attachment hole 57. In the dial 7, there is formed a slit 56 along a locus of the center F of the display armor 55, and the display armor 55 extends in a thickness direction of the timepiece 2 while penetrating through the slit 56 of the dial 7. A residual quantity display plate 61 is attached to an end part extending to a front face, side of the dial 7 within the display armor 55.

The center axes D, E, F are all perpendicular to a main face of the timepiece 2 or an extending face of the dial 7. In this example, there is made R3>R2.

In the main body part 5 of the residual wound quantity display mechanism 1 constituted like the above, a locus of the center, i.e., the motion point F, of the display arbor 55 becomes the internal trochoid (hypotrochoid). Here, the radius of a constant circle is R1, the radius of a motion circle is R2, and the distance from the motion point F till the rotation center E is R3.

Under a full wound state S1 in which the mainspring 11 is fully wound, the residual wound quantity display mechanism 1 constituted like the above takes an initial state shown in FIG. 1. Under this initial state or full wound state, as to the drive lever 40, its side edge 46 of the short arm part 42 butts against the angle butting pin 45, thereby adopting a position P1 in Which a D2-direction rotation more than it is prohibited. As understood from FIG. 1 and FIG. 4 in which one part of the former is shown while being enlarged, under this full wound state S1, the display member 50 adopts, as an initial position Q1, a D2-direction extreme position in which its drive gearwheel part 52 meshes with a D2-direction end part 73 of the fixation gearwheel 70, the arm part 53 of the display member 50 topples in the E2-direction, and the center F of the display arbor 55 adopts a G2-direction extreme position as an initial position U1.

Figure 5:
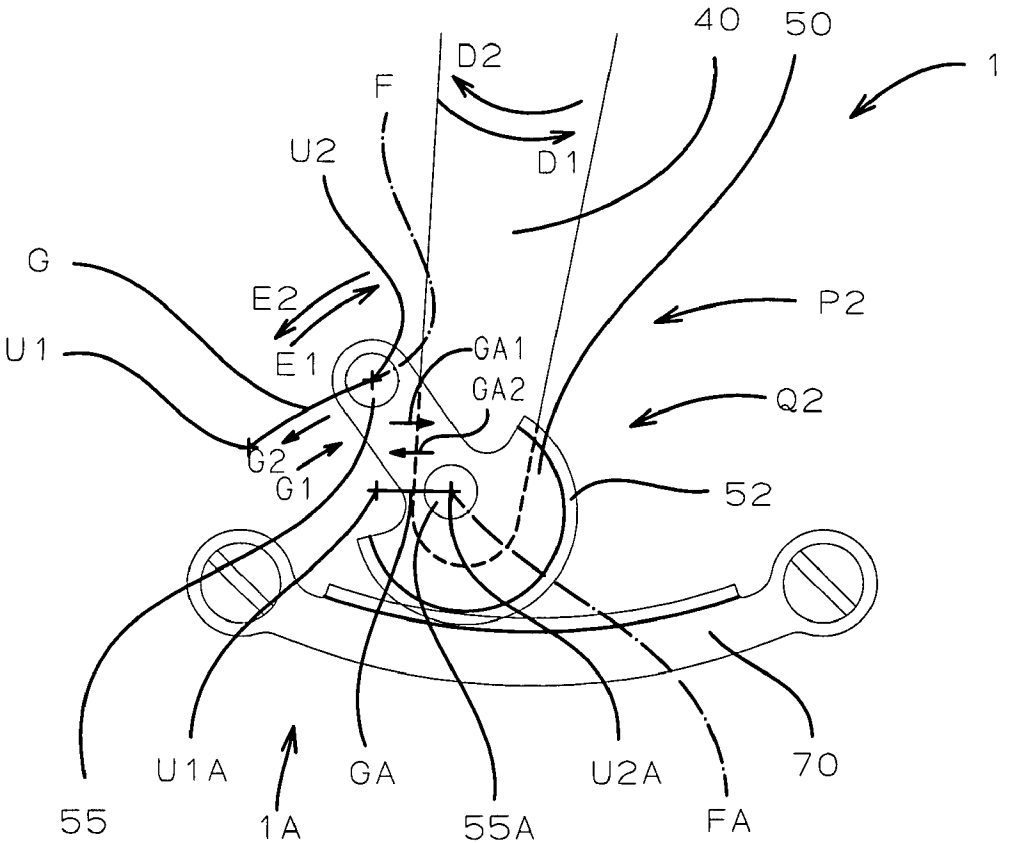
FIG. 5 is a partially enlarged explanatory plan view similar to FIG. 4, about the residual wound quantity display mechanism of FIG. 1, which exists under a state in which one part of a mainspring was unwound.

If the 2nd sun gearwheel 121 is rotated in the B1-direction in accordance with an operation of the planetary unit 100 complying with the unwinding of the mainspring 11 and, if the drive lever 40 is rotated in the D1-direction as shown in FIG. 5 in compliance with the B1-direction rotation-of the 2nd sun wheel 121 and arrives at a position P2, the drive gearwheel part 52 of the display member 50 rolls in the D1-direction along the fixation gearwheel 70 as shown in FIG. 5 in compliance with the D1-direction rotation of the drive lever 40 and arrives at a position Q2. The display member 50 is rotated, on the occasion of its D1-direction rolling, in the E1-direction about the center axis E as shown in FIG. 5. As a result, as shown in FIG. 5, the center F of the display arbor 55 swings in a G1-direction along a locus G forming a hypotrochoidal curve and arrives at a position U2.

Figure 6:
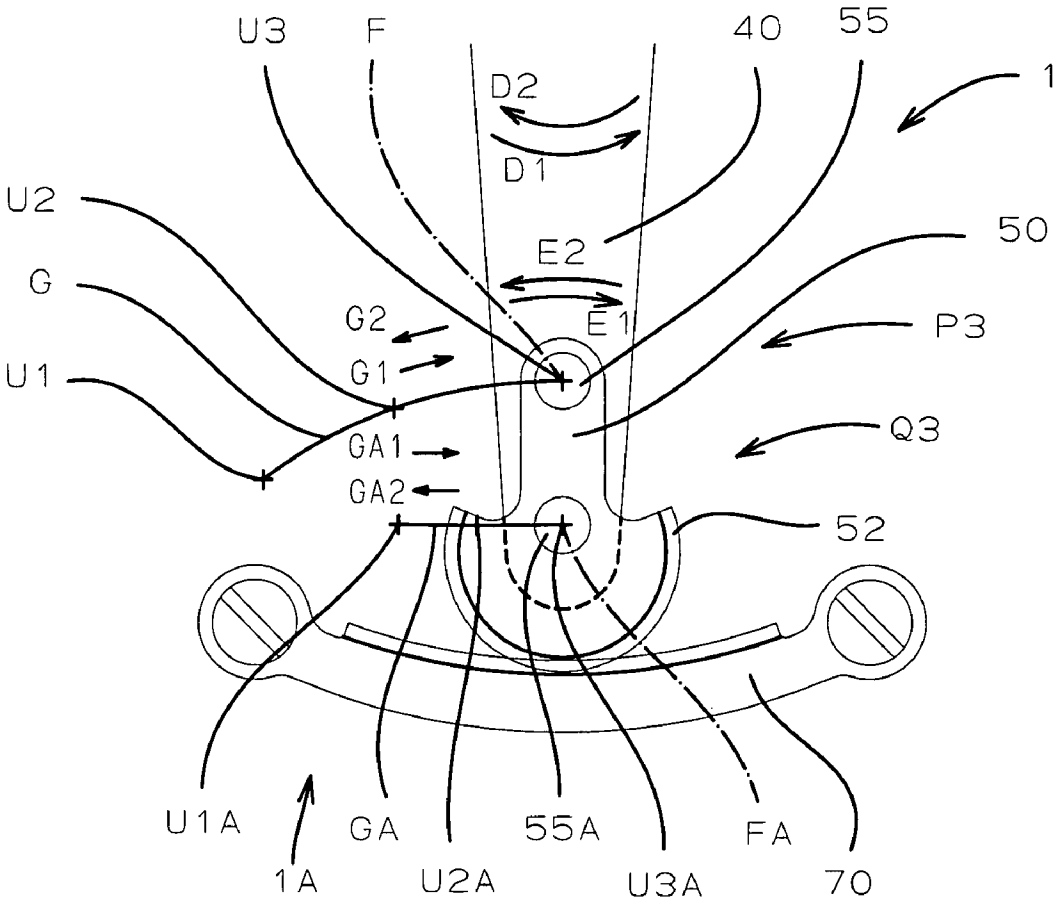
FIG. 6 is a partially enlarged explanatory plan view similar to FIG. 4, about the residual wound quantity display mechanism of FIG. 1, which exists under a state in which a half degree of the mainspring was unwound.

As shown in FIG. 6, in compliance with an additional unwinding of the mainspring 11, if the drive lever 40 arrives at a position P3, the drive gearwheel part 52 of the display member 50 arrives at a position Q3, and the center F of the display arbor 55 additionally swings in the G1-direction along the locus G forming the hypotrochoidal curve and arrives at a position U3.

Figure 7:
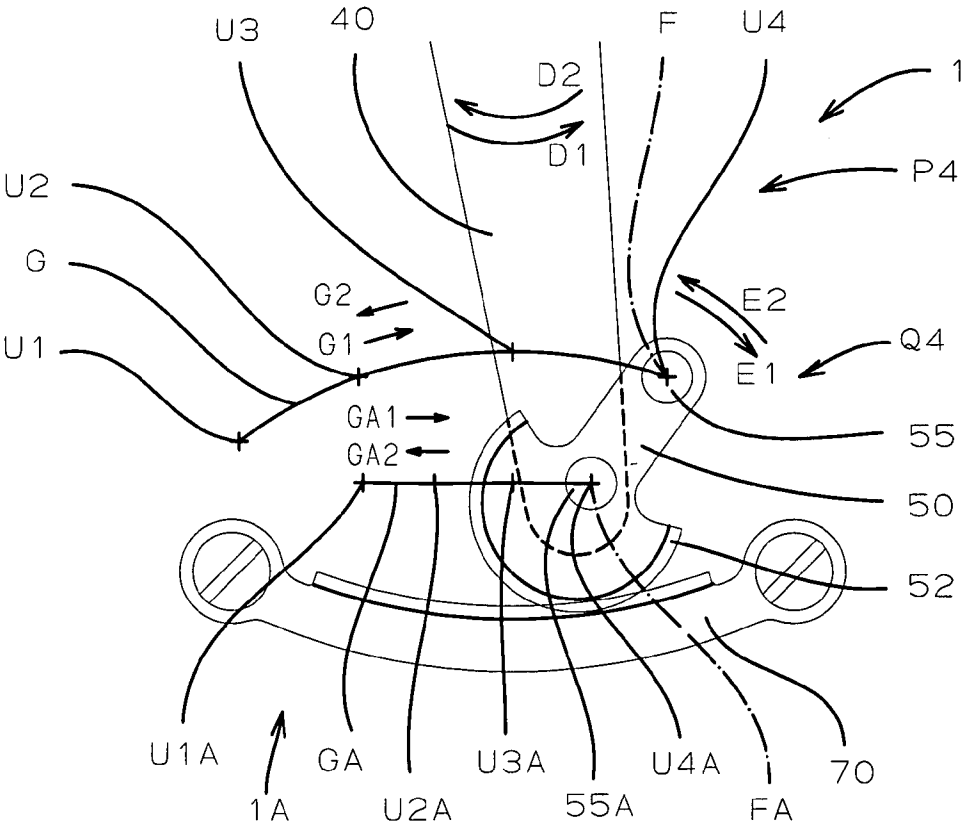
FIG. 7 is a partially enlarged explanatory plan view similar to FIG. 4, about the residual wound quantity display mechanism of FIG. 1, which exists under a state in which a majority of the mainspring was unwound.

Additionally, as shown in FIG. 7, in compliance with the unwinding of the mainspring 11, if the drive lever 40 arrives at a position P4, the drive gearwheel part 52 of the display member 50 arrives at a position Q4, and the center F of the display arbor 55 swings in the G1-direction along the locus G forming the hypotrochoidal curve and arrives at a position U4.

Figure 8:
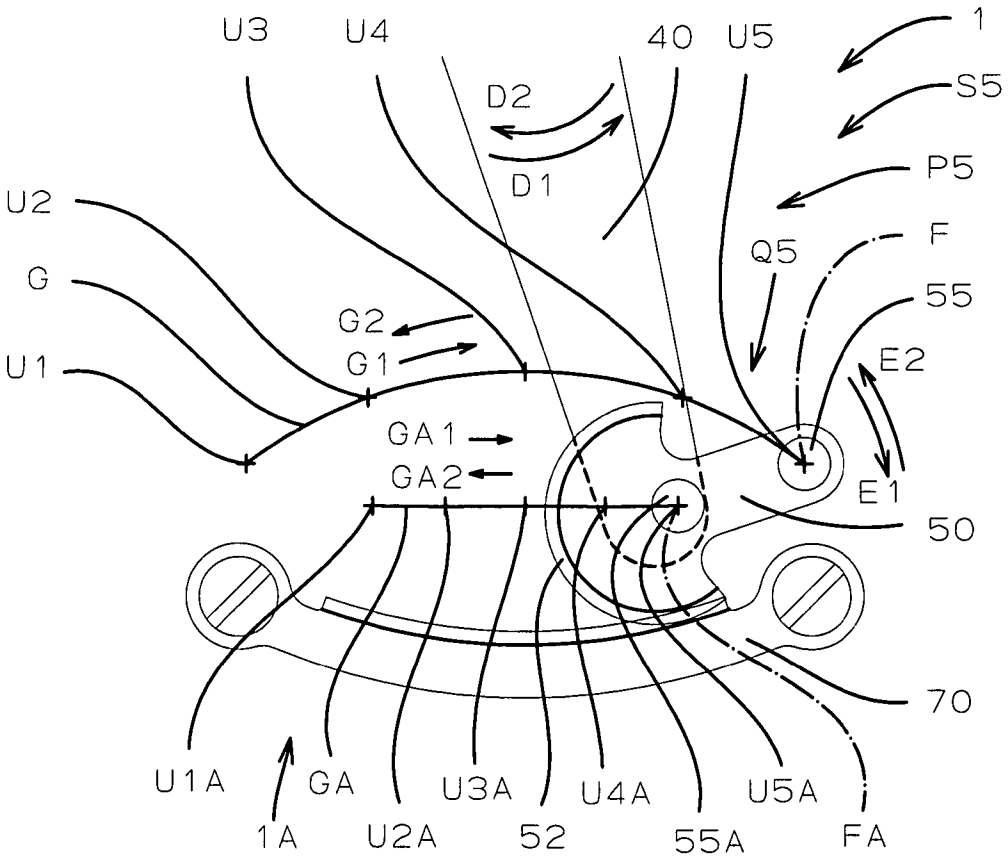
FIG. 8 is a partially enlarged explanatory plan view similar to FIG. 4, about the residual wound quantity display mechanism of FIG. 1, which exists under a state in which the mainspring was completely unwound.

As shown in FIG. 8, if the mainspring 11 is loosen by actually, completely performing the unwinding, the drive lever 40 arrives at a final position P5, the drive gearwheel part 52 of the display member 50 arrives at a final position Q5, and the center F of the display arbor 55 swings in the G1-direction along the locus G forming the hypotrochoidal curve and arrives at a final position U5.

Accordingly, as understood from FIG. 8, in compliance with the unwinding of the mainspring 11, the center F of the display arbor 55 moves from the position U1 to the final position U5 along the hypotrochoidal curve G while passing the positions U2, U3, U4.

When winding the mainspring 11, in compliance with the winding of the mainspring 11, the center F of the display arbor 55 returns from the position U5 to the initial position U1 along the hypotrochoidal curve G while passing the positions U4, U3, U2.

Figure 9:
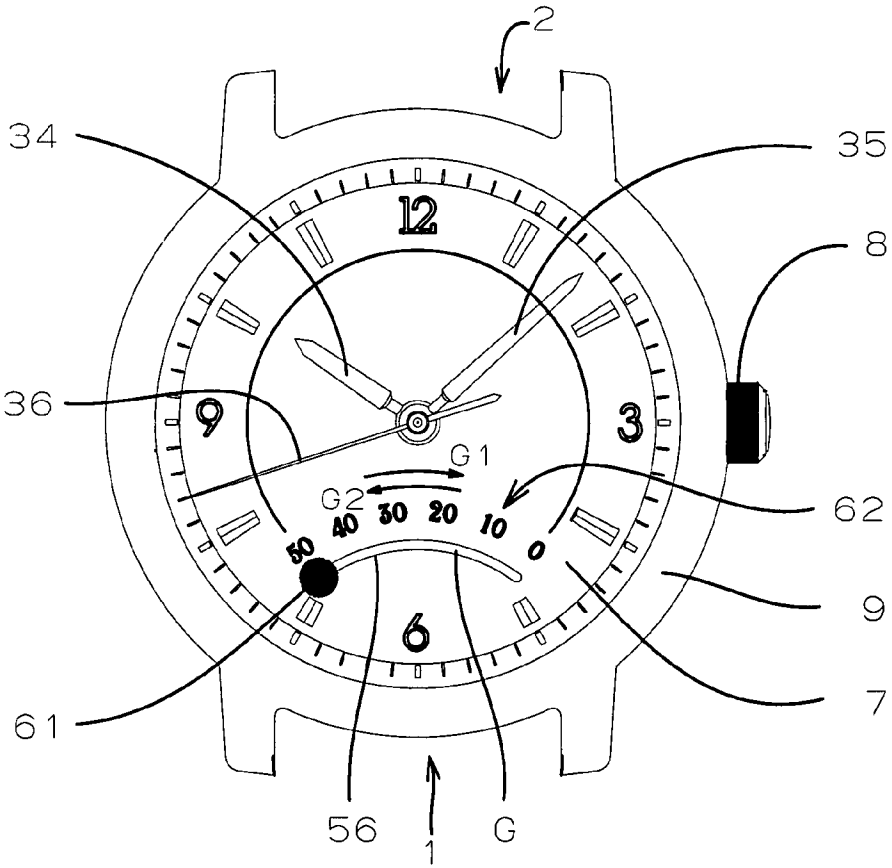
FIG. 9 is an explanatory plan view in which the mechanical timepiece of FIG. 1 was seen from a dial side.

Accordingly, as shown in FIG. 9, the residual quantity display plate 61 moves in the G1- and G2-directions along the slit 56 in a form of the hypotrochoidal curve G, which is formed in the dial 7. In FIG. 9, in the dial 7 there is applied a mainspring residual quantity graduation 62 along the slit 56 with the full wound position U1 corresponding to the full wound state S1 being made a 50-hour, and the residual quantity zero position U5 corresponding to a state S5 of a completely loosen residual quantity zero being made 0. A reference numeral 8 denotes a crown utilized in the winding of the mainspring 11. Incidentally, the main spring 11 may possess an automatic winding mechanism (not shown in the drawing) as well and, further, there may be made so as to be wound only by the automatic winding mechanism.

As understood from the movement slit 56 and the residual quantity graduation 62 of the residual quantity display plate 61 in the mechanical timepiece 2 of FIG. 9 and the locus G of FIG. 8, in this mechanical timepiece 2, the slit 56 has such an ark-like (In more detail, pseudo-arc-like or substantially arc-like) shape that its center exists outside the case 9 or outside the movement 3 of the timepiece 2.

Next, about a residual wound quantity display mechanism 1A of a modified example of the present invention, in which there is made so as to be capable of performing a straight-line-like display instead of the arc-like display, and a mechanical timepiece 2A possessing the mechanism 1A concerned, there are explained on the basis of FIG. 10-FIG. 12 and FIG. 4-FIG. 8.

Figure 10:
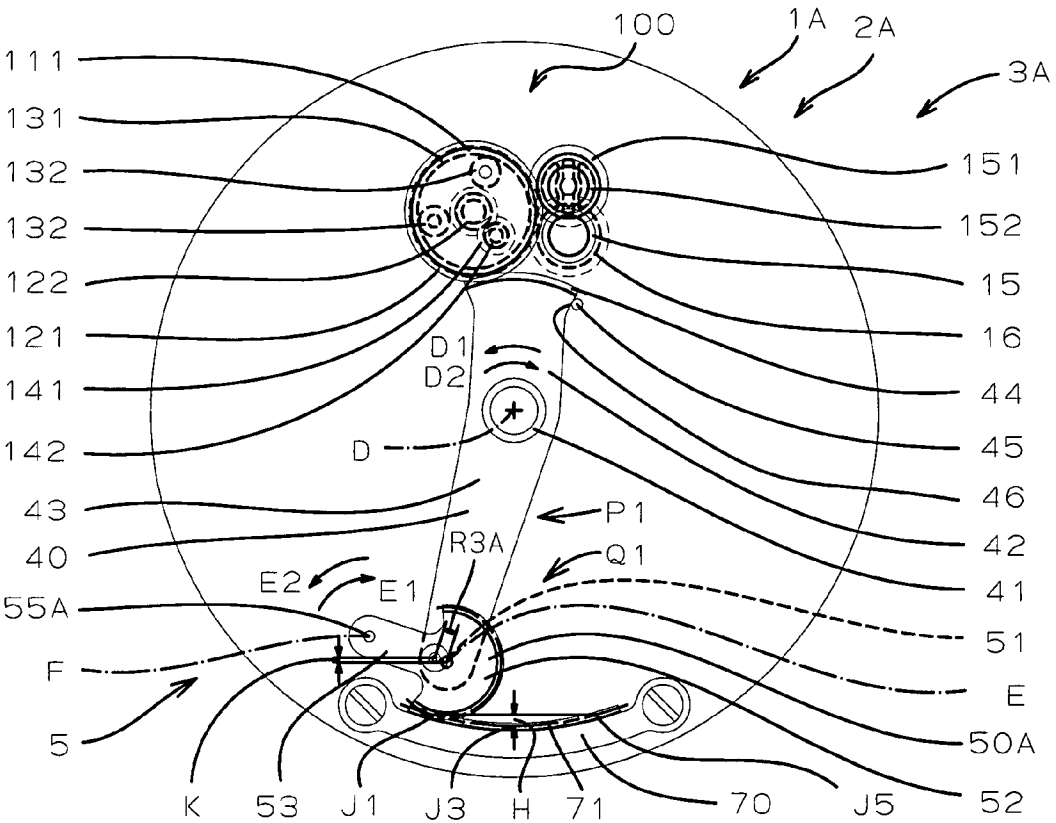
FIG. 10 is an explanatory plan view similar to FIG. 1, about a mechanical timepiece possessing a residual wound quantity display mechanism of one another, desirable embodiment of the present invention.

As understood from FIG. 10, the residual wound quantity display mechanism 1A of this modified example has a display arbor 55A in the vicinity of the rotation center E of the display member 50. That is, in this example, the display arbor 55A is fitted to a display arbor attachment hole 57A placed in the vicinity of the rotation center E instead of the display arbor attachment hole 57 of the display member 50. A distance (separated-center-length) R3A between a center FA of the display arbor 55A and the rotation center E of the display member 50 is small in comparison with the radius R2 of the pitch circle of the drive gearwheel 52 (R3A/R2<<1).

Figure 4:
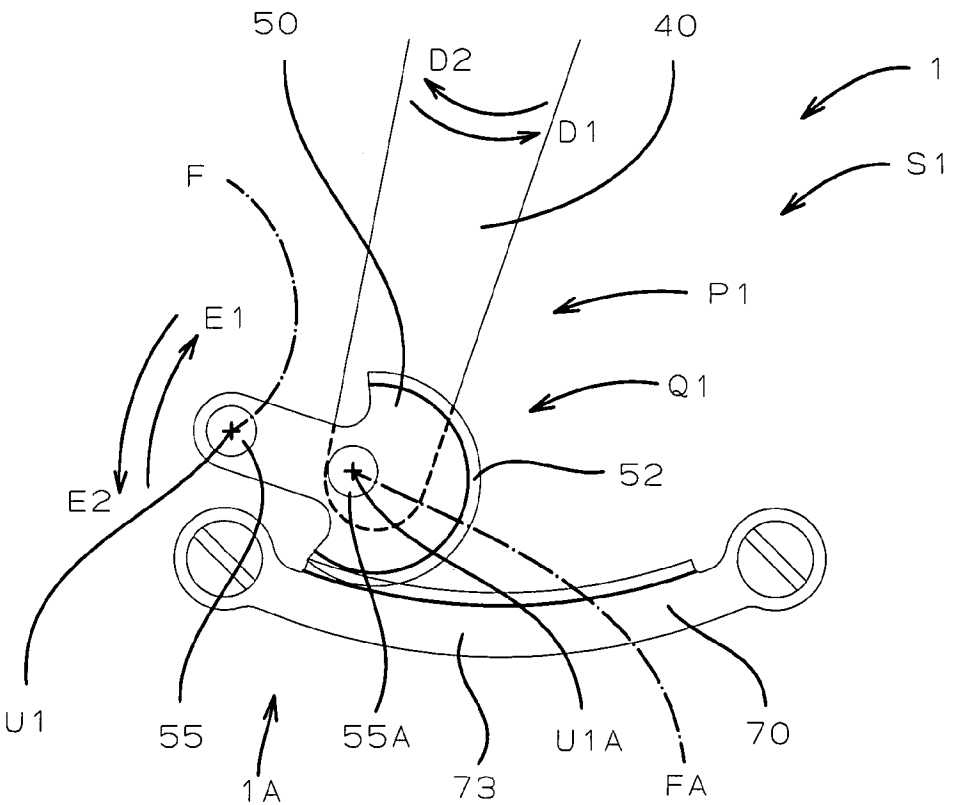
FIG. 4 is a partially enlarged explanatory plan view of the residual wound quantity display mechanism existing in an initial state, which shows an operation state of the residual wound quantity display mechanism of FIG. 1.

Incidentally, in more detail, for example, the separated-center length R3A is selected such that a distance H (more strictly, one in which a ratio ((R1−R2)/R1) between a distance (R1-R2) from the center axis D till the center axis E and the radius R1 of the pitch circle of the fixation gearwheel 70 is multiplied) between<<a virtual line V connecting a mesh position J1 in which the drive gearwheel 52 meshes with the fixation gearwheel 70 when existing in the initial position Q as shown in FIG. 10 and FIG. 4 and a mesh position J5 in which it meshes with the fixation gearwheel 70 when existing in an end point position Q5 as shown in FIG. 8>>and <<a mesh position J3 in which it meshes with the fixation gearwheel 70 when existing in the intermediate position Q3>>becomes the same degree as a difference between "the separated-center length R3A of the display arbor 55A" and "a distance K (where, a distance in a direction perpendicular to the above virtual line V) between a position U1A that a center FA of the display arbor 55A takes when the drive gearwheel part 52 exists in the initial position Q1 as shown in FIG. 10 and FIG. 4 and the rotation center E". If denoted by an expression, $$H^*(R1-R2)/R1 \cong R3A-K$$

However, here, there is supposed a case where the drive gearwheel part 52 adopts, in a case where it exists in the initial position Q1 and a case where it exists in the end point position Q5, a state symmetrical to a virtual line which is perpendicular to the above virtual line V and passes the center D.

In other words, by depicting a locus (not shown in the drawing) of the rotation center E of the display member 50, and selecting the R3A such that a maximum distance (In different words, there may be said a distance between the F (FA) and the E in FIG. 6 or a distance between the G and the E in a neutral position) from the line (G) connecting the U1 and the U5 so as to become equal to the R3A, a locus of pseudo-straight line is obtained.

Figure 11:
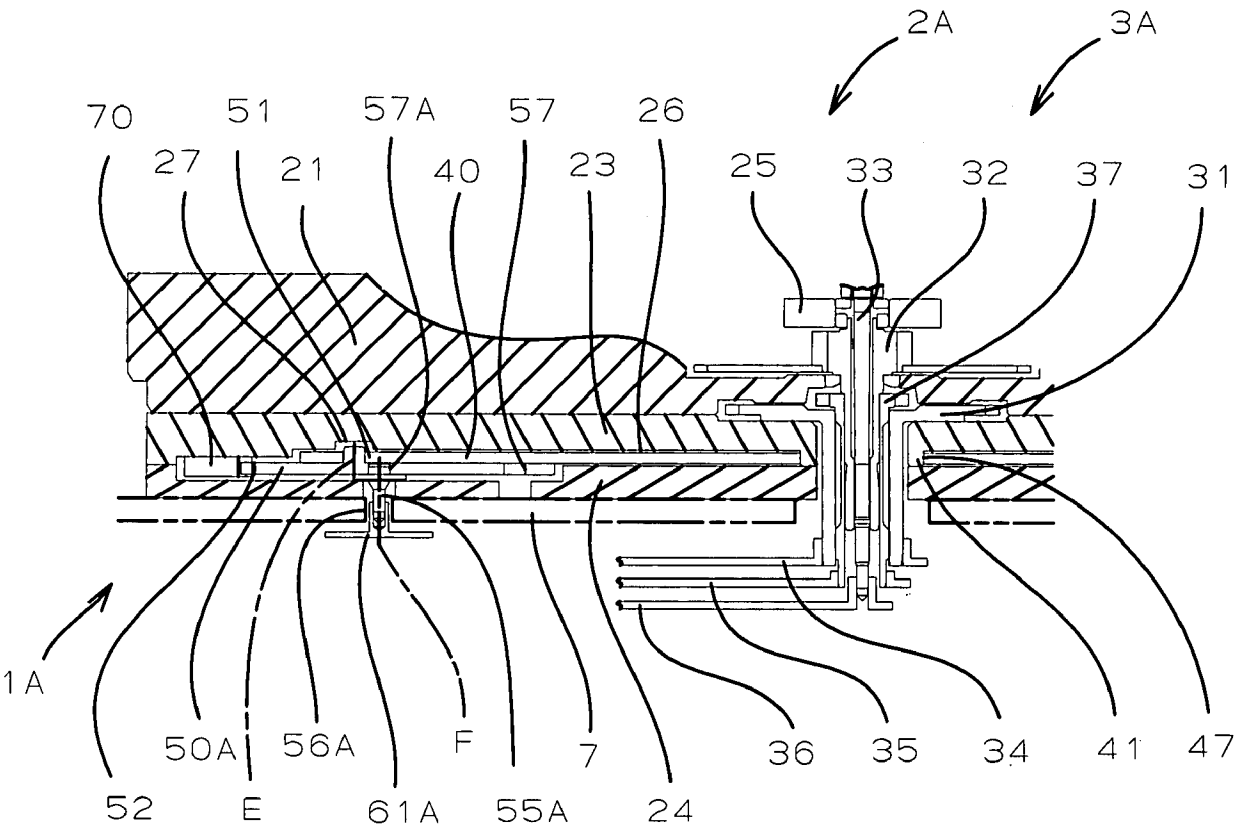
FIG. 11 is an explanatory sectional view similar to FIG. 3, about the mechanical timepiece of FIG. 10.
Figure 12:
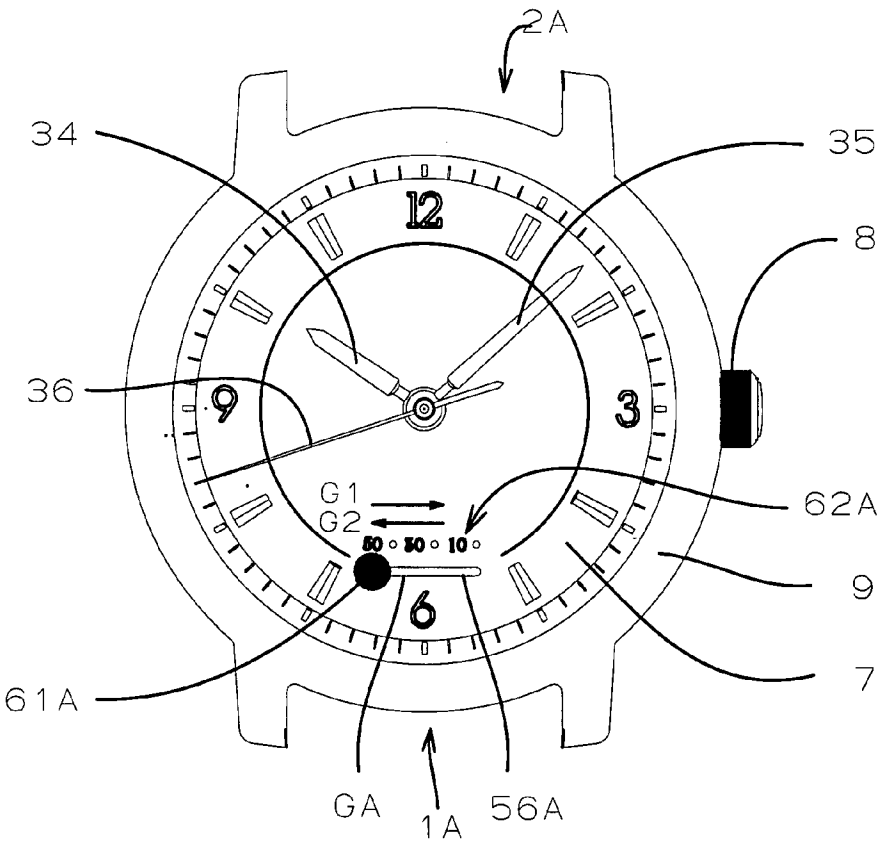
FIG. 12 is an explanatory plan view similar to FIG. 9, about the mechanical timepiece of FIG. 10.

In FIG. 10, FIG. 11 and FIG. 12, the same reference numeral or sign is applied to a member or element similar to FIG. 1, FIG. 3 and FIG. 9 and, as to a member or element in which there is an alteration, an annexed letter A is applied to a tail of the reference numeral or sign of a corresponding member or element.

Like the above, in the residual wound quantity display mechanism 1A in which the display armor 55A is attached to a hole 57A of a display member 50A and a residual quantity display plate 61A is attached to a tip of the display arbor 55A, in compliance with the E1-direction rotation of the drive gearwheel 52, which complies with the D1-direction rotation, of drive lever 40, following upon the unwinding of the mainspring 11, the center FA of the display arbor 55A displaces like the pseudo-straight line (practically like the straight line) in a GA1 direction from, as shown in FIG. 4 to FIG. 8, an initial position U1A (FIG. 4) till a final position U5A (FIG. 8) while passing a position U2A (FIG. 5), a position U3A (FIG. 6) and a position U4A (FIG. 7) along a locus GA. When winding the mainspring 11, there displaces like the pseudo-straight line to the positions U5A, U4A, U3A, U2A, U1A in a reverse direction GA2 along the locus GA.

Like this, only by altering the position in which the display arbor 55 or 55A is attached in regard to the arm part 53 of the display member 50, the locus that the display arbor 55 depicts can be altered from like the pseudo-arc to like the pseudo-straight line.

Accordingly, as shown in FIG. 12, in the mechanical timepiece 2A possessing this residual wound quantity display mechanism 1A, it possesses a straight-line-like slit 56A corresponding to the locus GA, and the display arbor 55A and the residual quantity display plate 61A are displaced practically like the straight line in the GA1- and GA2-directions along the straight-line-like slit 56A in compliance with the unwinding and the winding of the mainspring 11.

Incidentally, in the wound quantity display mechanism 1A of a movement 3A in the mechanical timepiece 2A of the embodiment shown in FIG. 10-FIG. 12, from the fact that the display arbor 55A and the residual quantity display plate 61A are displaced in a sufficiently small range in comparison with the radius R1 of the pitch circle of the fixation gearwheel 70, although that displacement can be approximated by the straight line, in order to make such that the display arbor 55A and the residual quantity display plate 61A are displaced like the straight line over a range of a considerable degree in comparison with the radius R1 of the pitch circle of the fixation gearwheel 70, there suffices if there is made such that two times of the radius R2 of the pitch circle of the drive gearwheel part 52 coincide with the radius R1 of the pitch circle of the fixation gearwheel 70 in accordance with a hypotrochoidal or hypocycloidal curve, and if the attachment hole 57A of the display arbor 55A is formed in the display member 50A such that the center FA of the display arbor 55A becomes a position separated from the center axis E by the distance R2. In that case, in order to make such that the slit 56A is placed, as shown in FIG. 12, in an outer periphery vicinity of the dial 7 not in a center part of the dial 7, there suffices if the rotation center axis D of the drive lever 40 is made a position (in mentioning about the example of FIG. 12, a position deviated to a side of 6 o'clock from the center) deviated from the center of the timepiece case 9.

Incidentally, even in a case where a disposition of the planetary unit 100 is difficult to be altered by being regulated by dispositions of other components constituting the movement, a display position of the residual wound quantity by the residual quantity display plate can be altered.

The example of FIG. 1-FIG. 9 and the example of FIG. 10-FIG. 12 are all examples of the hypotrochoid. Accordingly, generally, by considering a direction of the display arbor 55 in FIG. 1 for instance, the locus G (X, Y) is denoted as $$X=(R1-R2)\cos\theta-R3\cos((R1-R2)\theta/R2)$$

$$Y=(R1-R2)\sin\theta+R3\sin((R1-R2)\theta/R2)$$

Where, the X, Y are orthogonal coordinates with the rotation center of the drive lever 40 being made an origin as shown in FIG. 1, and a direction (in FIG. 1, a direction connecting the center D of the fixation lever 40 and a middle point (the position J3 in FIG. 10) of the fixation gear wheel 70) along which the arm part 43 extends in the position P3 of FIG. 6 corresponds to +X direction. The θ is a counterclockwise angle of the arm part 43 of the drive lever 40 and, when there exists in the position P3 of FIG. 6, θ=0 degree. Further, as mentioned later, in a case where the fixation gearwheel comprises the externally-toothed gearwheel (external gearwheel), there suffices if there is differently read as R1→−R1 and X→−X and Y→−Y.

Figure 13:
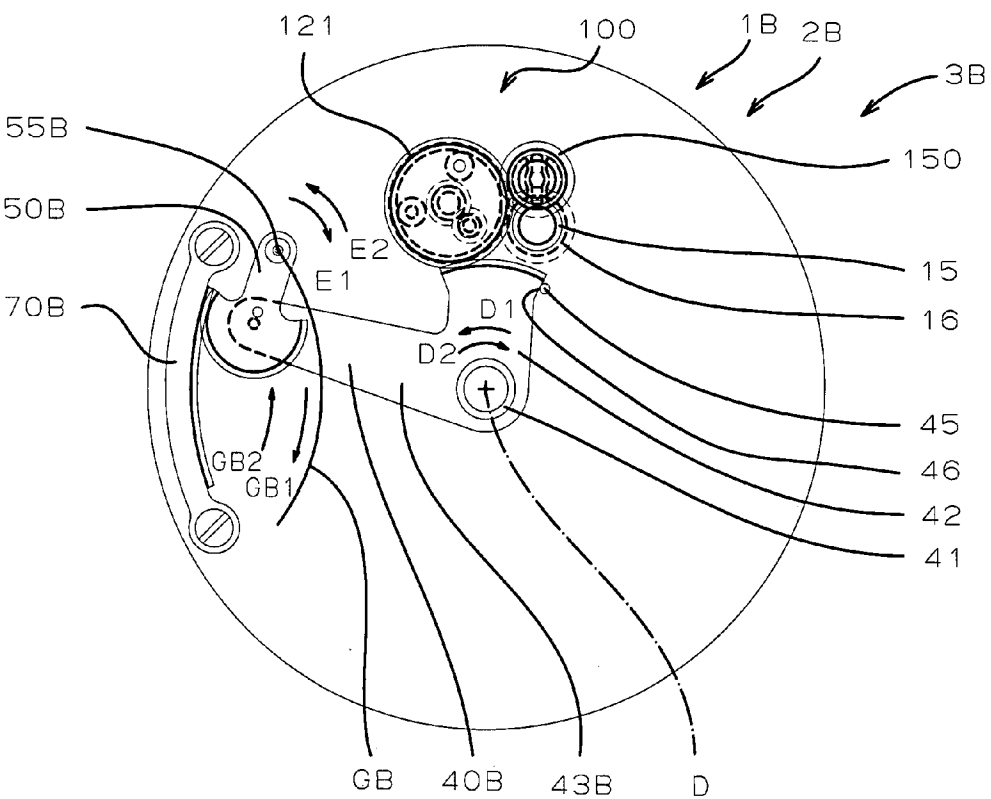
FIG. 13 is an explanatory plan view similar to FIG. 1, about a mechanical timepiece possessing a residual wound quantity display mechanism of one still another, desirable embodiment of the present invention.
Figure 14:
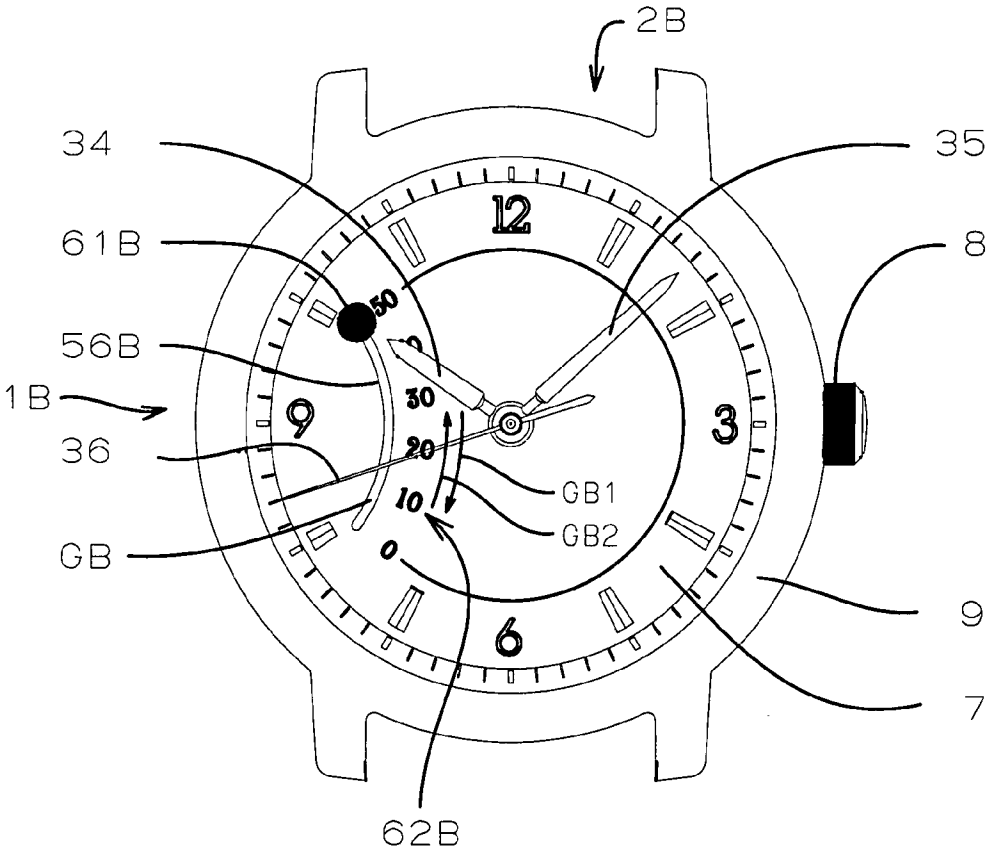
FIG. 14 is an explanatory plan view similar to FIG. 9, about the mechanical timepiece of FIG. 13.

In FIG. 13 and FIG. 14, there is shown an example in which there is made such that, in a case where the planetary unit 100 exists in a 12 O'clock position, the residual wound quantity is arc-like-displayed in a 9'oclock position. That is, in a mechanical timepiece 2B possessing a residual wound quantity display mechanism 1B shown in FIG. 13 and FIG. 14, it differs from the mechanical timepiece 2 possessing the residual wound quantity display mechanism 1 shown in FIG. 1-FIG. 9 in a point that the arc-like display is performed in the 9 o'clock position instead of the 6 o'clock position and, in other points, there is constituted similarly to the mechanical timepiece 2 possessing the residual wound quantity display mechanism 1 shown in FIG. 1-FIG. 9.

In FIG. 13 and FIG. 14, the same reference numeral or sign is applied to a member or element which is the same as the member or element shown in FIG. 1-FIG. 9 and, as to a member or element which corresponds although having a different point, an annexed letter B is applied to an end of the reference numeral or sign.

In the residual wound quantity display mechanism 1B of a movement 3B of the mechanical timepiece 2B, a drive lever 40B has the short arm part 42, and a long arm part 43B forming an angle of about 75 degrees in regard to the arm part 42 concerned. In other words, the drive lever 40B differs from the drive lever 40 in a point that the arm part 43B exists in an angular position deviated clockwise by 90 degrees in regard to the arm part 43 of the drive lever 40 and, in other points, it is constituted actually the same as the drive lever 40. That is, in this example, differing from the examples of FIG. 1 to FIG. 12, in which the rotation center D of the drive lever 40 exists inside a region prescribed by a line connecting the fixation gearwheel 70 and the output gearwheel 121, a rotation center of the drive lever 40B exists outside the region prescribed by a line connecting a fixation gearwheel 70B and the output gearwheel 121. Incidentally, in this example, an angle of the drive lever 40B and the arm part 43B may be bent at an acute angle or bent at an obtuse angle instead of being bent by about 90 degrees, and a direction of the acute angle or the obtuse angle may exist in a 3 o'clock side instead of a 9 o'clock side.

A relative position of a display member 50B in regard to the long arm part 43B of the drive lever 40B is the same as a relative position of the display member 50 in regard to the long arm part 43 of the drive lever 40. Accordingly, the display member 50B differs from the display member 50 in a point that it exists in an angular position deviated clockwise by 90 degrees in regard to the display member 50 of FIG. 1-FIG. 9 and, in other points, it is constituted actually the same as the display member 50. Similarly, a relative position of the fixation gearwheel 70B in regard to the long arm part 43B of the drive lever 40B is the same as a relative position of the fixation gearwheel 70 in regard to the long arm part 43 of the drive lever 40. Accordingly, the fixation gearwheel 70B differs from the fixation gearwheel 70 in a point that it exists in an angular position deviated clockwise by 90 degrees in regard to the fixation gearwheel 70 of FIG. 1-FIG. 9 and, in other points, it is constituted actually the same as the fixation gearwheel 70.

Further, in comparison with the display arbor 55 or the slit 56 or the residual quantity display plate 61 of FIG. 1-FIG. 9, also a display arbor 55B or a slit 56B or a residual quantity display plate 61B differs in a point that it exists in the angular position deviated clockwise by 90 degrees and, in other points, it is constituted actually the same. Incidentally, a point that also a residual quantity display graduation 62B exists in an angular position deviated clockwise by 90 degrees in regard to the residual quantity display graduation 62B is the same as other elements. However, in the residual quantity display graduation 62B, numerical values of the graduation are applied in such a direction that it is easy to confirm visually an ordinary timepiece display in which the 6 o'clock position becomes below and the 12 o'clock position becomes above.

In this mechanical timepiece 2B, the residual wound quantity is displayed by the fact that the residual quantity display plate 61B displaces in GB1- and GB2-directions along the inward arc-like slit 56B extending along a locus GB in the 9 o'clock position.

Figure 15:
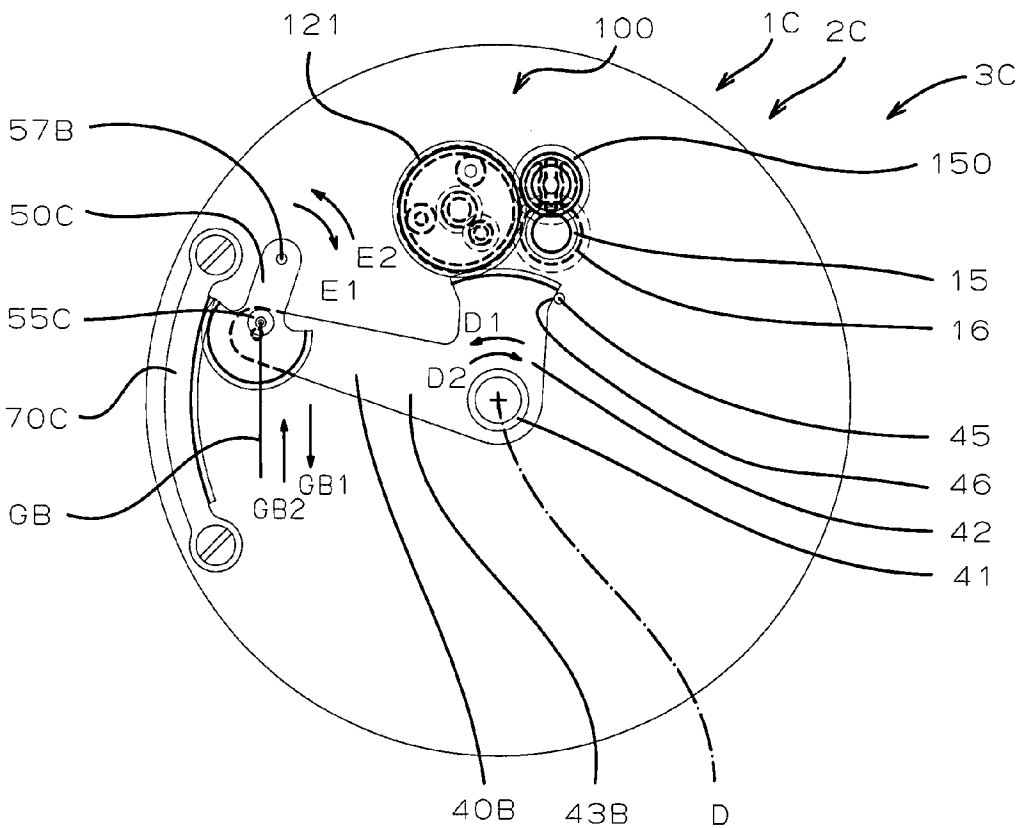
FIG. 15 is an explanatory plan view similar to FIG. 1, about a mechanical timepiece possessing a residual wound quantity display mechanism of one still another, desirable embodiment of the present invention.
Figure 16:
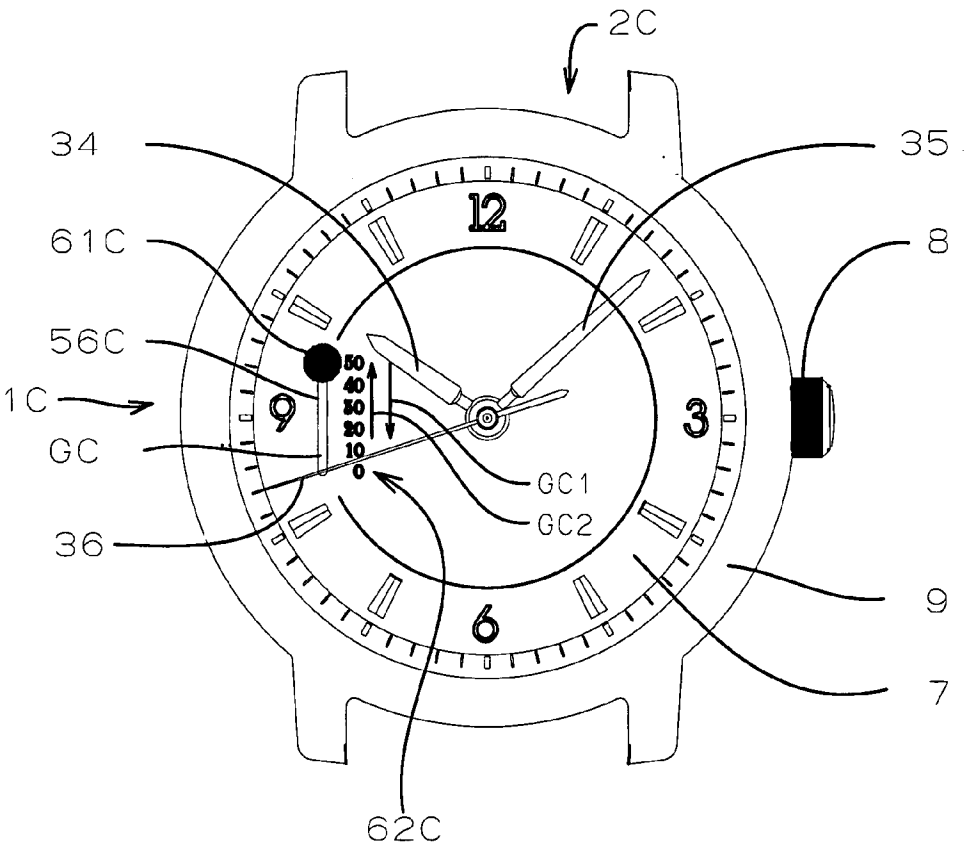
FIG. 16 is an explanatory plan view similar to FIG. 9, about the mechanical timepiece of FIG. 15.

In FIG. 15 and FIG. 16, there is shown an example in which there is made such that, in a case where the planetary unit 100 exists in the 12 o'clock position, the residual wound quantity is displayed like the straight line in the 9 o'clock position. That is, in a mechanical timepiece 2C possessing a residual wound quantity display mechanism 1C shown in FIG. 15 and FIG. 16, it differs from the mechanical timepiece 2A possessing the residual wound quantity display mechanism 1A shown in FIG. 10-FIG. 12 in a point that the arc-like display is performed in the 9 o'clock position instead of the 6 o'clock position and, in other points, it is constituted similarly to the mechanical timepiece 2A possessing the residual wound quantity display mechanism 1A shown in FIG. 10-FIG. 12. Further, in the mechanical timepiece 2C possessing the residual wound quantity display mechanism 1C shown in FIG. 15 and FIG. 16, it differs from the mechanical timepiece 2B possessing the residual wound quantity display mechanism 1B shown in FIG. 13-FIG. 14 in a point that the straight-line-like display is performed and, in other points, it is constituted similarly to the mechanical timepiece 2B possessing the residual wound quantity display mechanism 1B shown in FIG. 13-FIG. 14.

In FIG. 15 and FIG. 16, the same reference numeral or sign is applied to the member or element shown in FIG. 1-FIG. 9 or FIG. 10-FIG. 12 or FIG. 13-FIG. 14 and, to a member or element which corresponds although having a different point, an annexed letter C is applied to an end of the reference numeral or sign.

In the residual wound quantity display mechanism 1C of a movement 3C of the mechanical timepiece 2C, the drive lever 40B has, similarly to the residual wound quantity display mechanism 1B of the mechanical timepiece 2B, the short arm part 42, and the long arm part 43B forming the angle of about 75 degrees in regard to the arm part 42 concerned.

A relative position of a display member 50C in regard to the long arm part 43B of the drive lever 40B is the same as a relative position of a display member 50A in regard to the long arm part 43 of the drive lever 40 of the wound quantity display mechanism 1A. Accordingly, the display member 50C differs from the display member 50A in a point that it exists in an angular position deviated clockwise by 90 degrees in regard to the display member 50A of FIG. 10-FIG. 12 and, in other points, it is constituted actually the same as the display member 50A. Similarly, a relative position of the fixation gearwheel 70B in regard to the long arm part 43B of the drive lever 40B is the same as a relative position of the fixation gearwheel 70 in regard to the long arm part 43 of the drive lever 40. Accordingly, the fixation gear wheel 70B differs from the fixation gearwheel 70 in the point that it exists in the angular position deviated clockwise by 90 degrees in regard to the fixation gearwheel 70 of FIG. 10-FIG. 12 and, in other points, it is constituted actually the same as the fixation gearwheel 70.

Further, in comparison with the display arbor 55A or the slit 56A or the residual quantity display plate 61A of FIG. 10-FIG. 12, also a display arbor 55C or a slit 56C or a residual quantity display plate 61C differs in the point that it exists in the angular position deviated clockwise by 90 degrees and, in other points, it is constituted actually the same. Incidentally, a point that also a residual wound quantity display graduation 62C exists in an angular position deviated clockwise by 90 degrees in regard to the residual quantity display graduation 62A is the same as other elements. However, in the residual quantity display graduation 62C, numerical values of the graduation are applied in such a direction that it is easy to confirm visually the ordinary timepiece display in which the 6 o'clock position becomes below and the 12 o'clock position becomes above.

In this mechanical timepiece 2C, the residual wound quantity is displayed by the fact that the residual quantity display plate 61C displaces in GC1- and GC2-directions along the straight-line-like slit 56C extending along a locus GC in the 9 o'clock position.

Although a kind of the locus of the display arbor becomes limitative, if desired, the fixation gearwheel may be an externally-toothed gearwheel (external gearwheel) instead of the internally-toothed gearwheel (internal gearwheel).

In FIG. 17-FIG. 20, there is shown a mechanical timepiece 2D having a residual wound quantity display mechanism 1D possessing a fixation gearwheel 70D in the form of an arc-like externally-toothed gearwheel, which forms one part of a spur gearwheel.

In the mechanical timepiece 2D having the residual wound quantity display mechanism 1D, which is shown in FIG. 17 to FIG. 20, the same reference numeral or sign is applied to a member or element which is the same as the member or element shown in FIG. 1-FIG. 9 and, as to a member or element which corresponds although having a different point, an annexed letter D is applied to the end of the reference numeral or sign.

Figure 19:
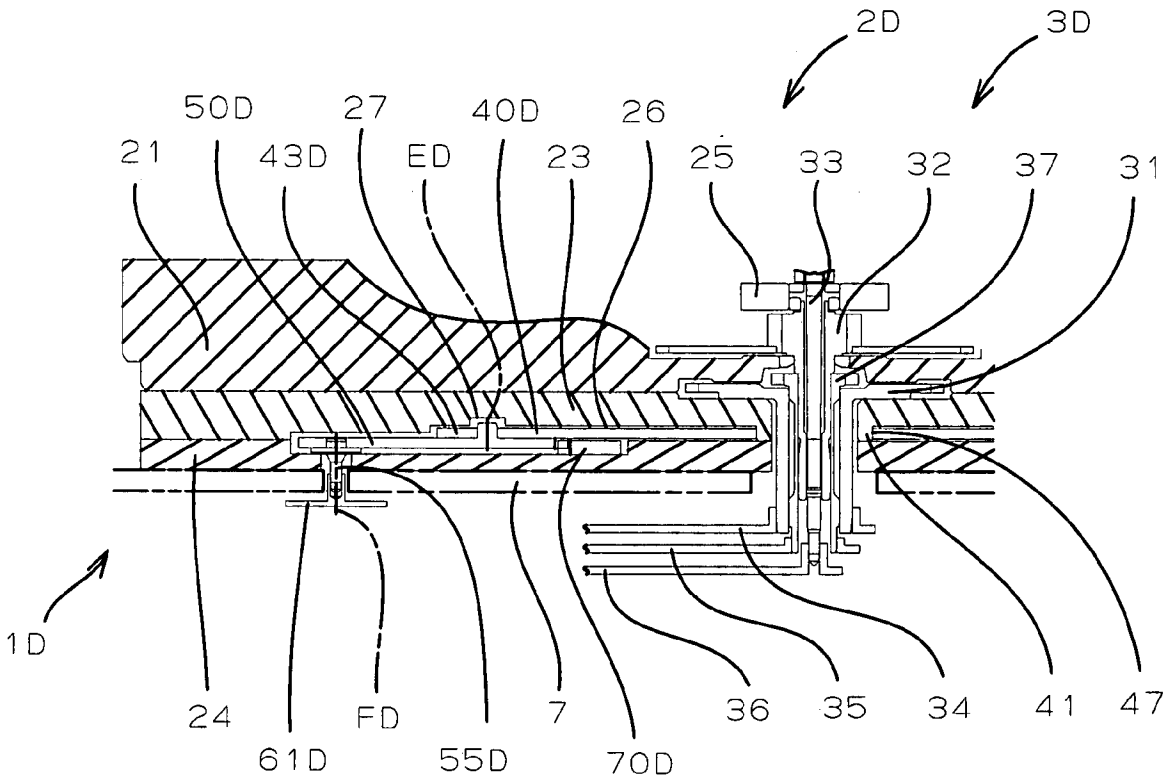
FIG. 19 is an explanatory sectional view similar to FIG. 3, about the mechanical timepiece of FIG. 17.

As understood from FIG. 19, in the residual wound quantity display mechanism 1D of a movement 3D of the mechanical timepiece 2D, the fixation gearwheel 70D in the form of the arc-like external gearwheel 71D is fixed to the 2nd main plate 23, and a long arm part 43D of a drive lever 40D extends beyond the fixation gearwheel 70D. A display member 50D mounted to a tip part of the arm part 43D so as to be rotatable in ED1- and ED2-directions about a center-axis ED meshes with the arc-like external gearwheel part 71D of the fixation gearwheel 70D by a drive gearwheel part 52D.

Figure 17:
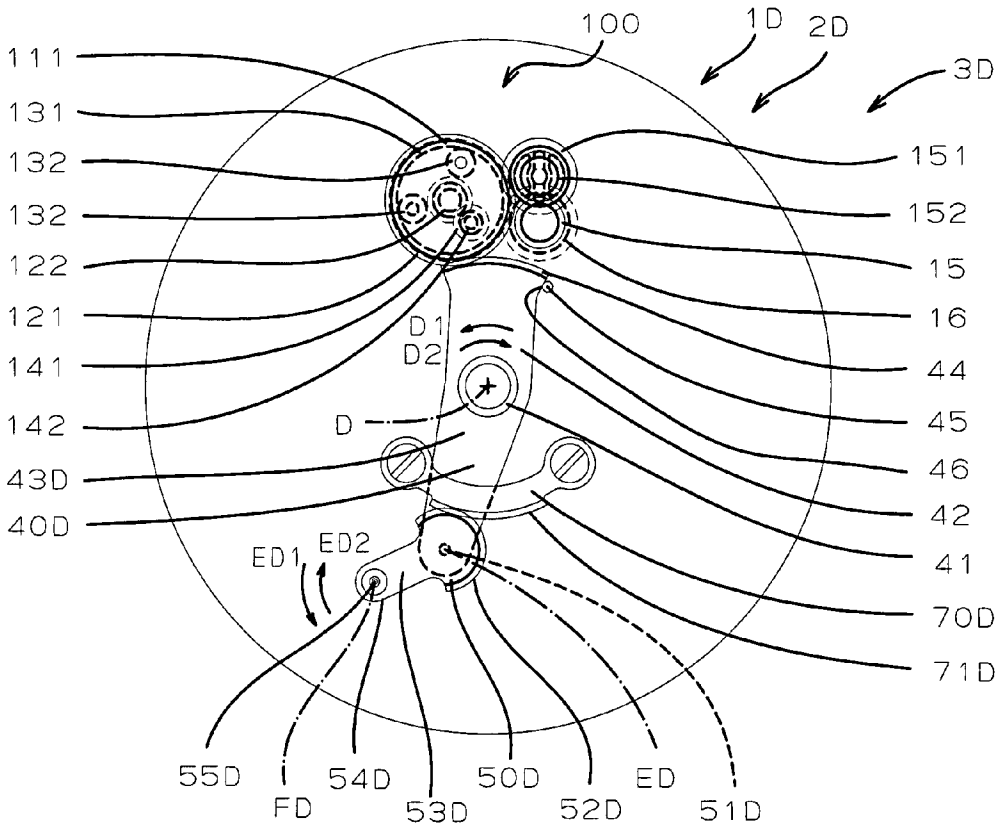
FIG. 17 is an explanatory plan view similar to FIG. 1, about a mechanical timepiece possessing a residual wound quantity display mechanism of one still another, desirable embodiment of the present invention.

As shown in FIG. 17, in a display member 50D, from the fact that its drive gearwheel part 52D meshes with the arc-like external gearwheel part 71D of the fixation gearwheel 70D, a display arbor 55D of the display member 50 is placed in an outer periphery side of the timepiece 2D than the center axis ED, and it is constituted substantially similar to the display member 50 of the residual wound quantity display mechanism 1 of the mechanical timepiece 2 except a point rotating in the ED1- and ED2-directions.

Figure 18:
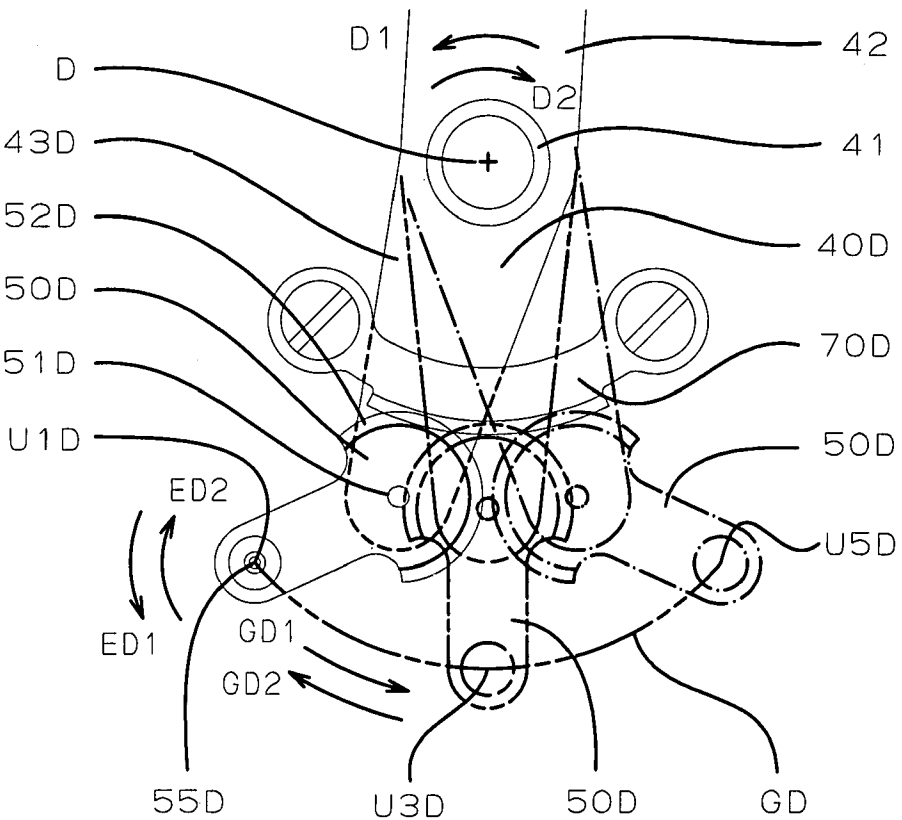
FIG. 18 is a partially enlarged explanatory plan view similar to FIG. 4.

As understood from FIG. 18, in the residual wound quantity display mechanism 1D of this mechanical timepiece 2D, in compliance with the D1-direction rotation of the drive lever 40D, which follows-upon the unwinding of the mainspring 11, the drive gearwheel 52D of the display member-50D rolls along the fixation gearwheel 70 in the form of the externally-toothed gearwheel 71D while rotating in the ED1-direction. Accordingly, a display arbor 55D which existed in an initial position U1D displaces in a GD1 direction along an outwardly convex arc-like locus GD, and arrives at a final position U5D while passing an intermediate position U3D. Incidentally, when winding the mainspring 11, in compliance with a D2-direction rotation of the drive lever 40D, the display arbor 55D returns to the initial position U1D from the position U5D along the locus GD while passing the intermediate position U3D.

Figure 20:
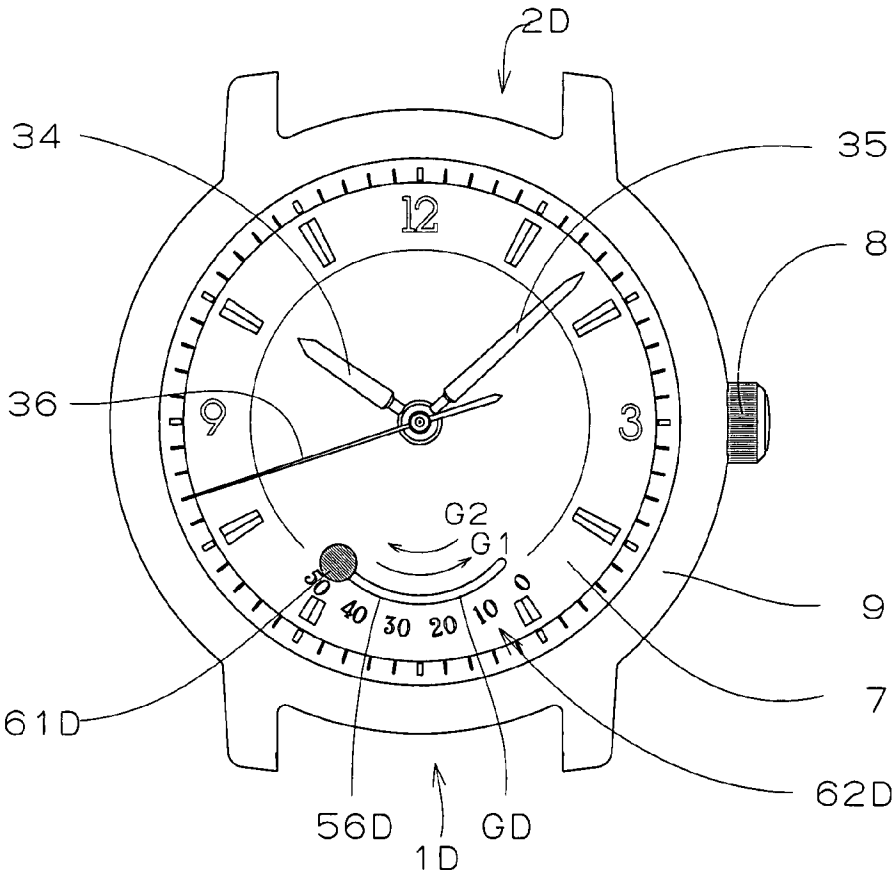
FIG. 20 is an explanatory sectional view similar to FIG. 9, about the mechanical timepiece of FIG. 17.

Accordingly, as shown in FIG. 20, in the mechanical timepiece 2D, a residual quantity display plate 61D displaces in the GD1- and GD2-directions along an outwardly convex arc-like slit 56D formed so as to coincide with the outwardly convex arc-like locus GD, thereby displaying the residual wound quantity basing on a residual wound quantity display graduation 62D shown in the dial 7.

What is claimed is:

1. A residual wound quantity display mechanism of a timepiece, comprising:

an output gearwheel rotating in compliance with a change in a residual wound quantity of a mainspring;

a drive lever possessing monolithically a fan-shaped gearwheel part meshing with the output gearwheel, and an arm part extending from a rotation center of the fan-shaped gearwheel part in a direction different from a fan-shaped portion of the fan-shaped gearwheel part;

a display member possessing a drive gearwheel part rotatably supported to the arm part of the drive lever, and a display arbor formed monolithically in the drive gearwheel part in a site separated from a rotation center of the drive gearwheel part; and a fixation gearwheel possessing a fixation tooth part with which a tooth part of the drive gearwheel part of the display member meshes.

2. A residual wound quantity display mechanism of a timepiece according to claim 1, wherein the fixation gearwheel is an internally-toothed gearwheel.

3. A residual wound quantity display mechanism of a timepiece according to claim 1, wherein a distance from the display arbor till the rotation center of the drive gearwheel part is smaller than a radius of a pitch circle of the drive gearwheel part.

4. A residual wound quantity display mechanism of a timepiece according to claim 2, wherein a distance from the display arbor till the rotation center of the drive gearwheel part is smaller than a radius of a pitch circle of the drive gearwheel part.

5. A residual wound quantity display mechanism of a timepiece according to claim 3, wherein a locus formed by the display arbor is like a pseudo-straight line.

6. A residual wound quantity display mechanism of a timepiece according to claim 4, wherein a locus formed by the display arbor is like a pseudo-straight line.

7. A residual wound quantity display mechanism of a timepiece according to claim 1, wherein a distance from the display arbor till the rotation center of the drive gearwheel part is larger than a radius of a pitch circle of the drive gearwheel part.

8. A residual wound quantity display mechanism of a timepiece according to claim 2, wherein a distance from the display arbor till the rotation center of the drive gearwheel part is larger than a radius of a pitch circle of the drive gearwheel part.

9. A residual wound quantity display mechanism of a timepiece according to claim 7, wherein a locus formed by the display arbor is like an arc, and a center of the arc is placed outside an outer periphery of the timepiece.

10. A residual wound quantity display mechanism of a timepiece according to claim 8, wherein a locus formed by the display arbor is like an arc, and a center of the arc is placed outside an outer periphery of the timepiece.

11. A residual wound quantity display mechanism of a time piece according to claim 1, wherein the fixation gearwheel is an externally-toothed gearwheel.

12. A residual wound quantity display mechanism of a timepiece according to claim 1, wherein a rotation center of the drive lever exists inside a region prescribed by a line connecting the fixation gearwheel and the output gearwheel.

13. A residual wound quantity display mechanism of a timepiece according to claim 2, wherein a rotation center of the drive lever exists inside a region prescribed by a line connecting the fixation gearwheel and the output gearwheel.

14. A residual wound quantity display mechanism of a timepiece according to claim 11, wherein a rotation center of the drive lever exists inside a region prescribed by a line connecting the fixation gearwheel and the output gearwheel.

15. A residual wound quantity display mechanism of a timepiece according to claim 1, wherein a rotation center of the drive lever exists outside a region prescribed by a line connecting the fixation gearwheel and the output gearwheel.

16. A residual wound quantity display mechanism of a timepiece according to claim 2, wherein a rotation center of the drive lever exists outside a region prescribed by a line connecting the fixation gearwheel and the output gearwheel.

17. A residual wound quantity display mechanism of a timepiece according to claim 11, wherein a rotation center of the drive lever exists outside a region prescribed by a line connecting the fixation gearwheel and the output gearwheel.

18. A timepiece with a residual wound quantity display mechanism, which possesses the residual wound quantity display mechanism according to claim 1.

19. A timepiece with a residual wound quantity display mechanism, which possesses the residual wound quantity display mechanism according to claim 2.

20. A timepiece with a residual wound quantity display mechanism, which possesses the residual wound quantity display mechanism according to claim 11.

* * * * *